US010718304B2

(12) United States Patent
Ishii et al.

(10) Patent No.: US 10,718,304 B2
(45) Date of Patent: Jul. 21, 2020

(54) FUEL INJECTION VALVE

(71) Applicant: Hitachi, Ltd., Chiyoda-ku, Tokyo (JP)

(72) Inventors: Eiji Ishii, Tokyo (JP); Kazuki Yoshimura, Tokyo (JP); Taisuke Sugii, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 86 days.

(21) Appl. No.: 16/070,690

(22) PCT Filed: Dec. 16, 2016

(86) PCT No.: PCT/JP2016/087463
§ 371 (c)(1),
(2) Date: Jul. 17, 2018

(87) PCT Pub. No.: WO2017/126259
PCT Pub. Date: Jul. 27, 2017

(65) Prior Publication Data

US 2019/0063392 A1 Feb. 28, 2019

(30) Foreign Application Priority Data

Jan. 18, 2016 (JP) ..... 2016-006754

(51) Int. Cl.
*F02M 61/18* (2006.01)
*B05B 1/26* (2006.01)

(52) U.S. Cl.
CPC ..... *F02M 61/1806* (2013.01); *B05B 1/262* (2013.01); *B05B 1/265* (2013.01);
(Continued)

(58) Field of Classification Search
CPC ..... F02M 61/1806; F02M 61/18; F02M 61/1833; F02M 61/1886; B05B 1/262; B05B 1/265
(Continued)

(56) References Cited

U.S. PATENT DOCUMENTS 4,726,523 A * 2/1988 Kokubo ..... B05B 17/0623 239/584
6,267,307 B1 * 7/2001 Pontoppidan ..... F02M 61/06 239/104
(Continued)

FOREIGN PATENT DOCUMENTS

JP 2003-214294 A 7/2003
JP 2006-70755 A 3/2006
(Continued)

OTHER PUBLICATIONS

International Search Report (PCT/ISA/210) issued in PCT Application No. PCT/JP2016/087463 dated Feb. 21, 2017 with English translation (four (4) pages).
(Continued)

*Primary Examiner* — Steven J Ganey
(74) *Attorney, Agent, or Firm* — Crowell & Moring LLP

(57) ABSTRACT

It is prevented that residual fuel left in the vicinity of an injection nozzle outlet is carbonized to cause adherence of the carbonized fuel as deposit and changing of a spray pattern or an injection flow rate. A fuel injection valve includes a seat portion on which a valve body is seated and a seat portion in which an injection hole for injecting fuel downstream from the seat portion is formed, in which a concave surface denting in a direction opposite to a fuel injecting direction is formed on an outer peripheral side away from the injection hole at an end face located downstream of the seat member, and the concave surface is formed such that a material surface in an outer peripheral region has a larger wettability for the fuel than in an inner peripheral region.

10 Claims, 9 Drawing Sheets

(52) U.S. Cl.
CPC ..... *F02M 61/18* (2013.01); *F02M 61/1833* (2013.01); *F02M 61/1886* (2013.01)

(58) Field of Classification Search
USPC ..... 239/103, 104, 106, 120, 498, 500, 502, 239/533.12, 584, 585.1, 585.4, 585.5, 601
See application file for complete search history.

(56) References Cited

U.S. PATENT DOCUMENTS

| | | | | |
|---|---|---|---|---|
| 7,080,796 | B2 * | 7/2006 | Tomiita | F02M 61/1806 239/103 |
| 7,651,038 | B2 * | 1/2010 | Shimizu | F02M 61/166 239/533.12 |
| 7,828,232 | B2 * | 11/2010 | Oomori | F02M 51/061 239/104 |
| 2009/0201334 | A1 | 8/2009 | Hasegawa | |

FOREIGN PATENT DOCUMENTS

| | | | |
|---|---|---|---|
| JP | 2007-321592 | A | 12/2007 |
| JP | 2008-184977 | A | 8/2008 |
| JP | 2008-196362 | A | 8/2008 |
| JP | 2008-291722 | A | 12/2008 |
| JP | 2009-190233 | A | 8/2009 |

OTHER PUBLICATIONS

Japanese-language Written Opinion (PCT/ISA/237) issued in PCT Application No. PCT/JP2016/087463 dated Feb. 21, 2017 (five(5) pages).

* cited by examiner

FUEL INJECTION VALVE

TECHNICAL FIELD

The present invention relates to a fuel injection valve used for an internal combustion engine, such as a gasoline engine, in which a valve touches a valve seat to prevent leakage of fuel and a valve moves away from the valve seat to allow injection.

BACKGROUND ART

In a past invention, a surface on an outlet side of a fuel injection hole has a coarse surface roughness and a cross-sectional area on the outlet side of the fuel injection hole is larger than a cross-sectional area on an inlet side. This causes active accumulation of deposit on an outlet portion of fuel to decrease adherence of deposit on the inlet side (measuring portion) of the fuel.

In another past invention, radially-shaped grooves are formed on a lower end face (on a fuel outlet side of a fuel injection hole) of a fuel injection valve to guide fuel from a fuel outlet of the injection hole toward an outer peripheral side. Thus, retention of the fuel around the fuel outlet and accumulation of deposit in accordance with the retention of the fuel are reduced.

CITATION LIST

Patent Literature

PTL 1: JP 2007-321592 A
PTL 2: JP 2008-196362 A

SUMMARY OF INVENTION

Technical Problem

In a fuel injection apparatus for vehicle engines, fuel left in the vicinity of an outlet of an injection nozzle is carbonized in or after injection of fuel, and the carbonized fuel is adhered as deposit. The deposit grows over time during use of the injection apparatus to eventually clog a part of the outlet of the injection nozzle, causing a change in a spray pattern or an injection flow rate. Therefore, it has been needed to decrease an amount of the fuel left in the vicinity of the outlet of the injection nozzle in or after the injection of fuel.

In one example of the past technique mentioned above, a surface roughness in the vicinity of an outlet side of a fuel injection hole is made coarse, while a cross-sectional area of the outlet side of the fuel injection hole is formed larger than a cross-sectional area of an inlet side of the fuel injection hole to actively accumulate deposit at an outlet portion and decrease the deposit from being adhered to the inlet side (measuring portion) of the fuel. In this prior art technique, however, there is a problem that, since the deposit is adhered to the outlet of the injection nozzle, the deposit gradually grows until it clogs the outlet of the injection nozzle to eventually cause a change of a spray pattern or an injection flow rate over time.

Further, in another prior art technique, there is a problem that, since it is costly to form radial grooves on a lower end face (on a fuel outlet side of a fuel injection hole) of a fuel injection valve, and collection of fuel cannot be carried out in a region other than a region where the radial grooves are formed, retention of the fuel cannot sufficiently be reduced.

Solution to Problem

To solve the above problems, the present invention provides a fuel injection valve including a seat portion on which a valve body is seated and a seat portion in which an injection hole for injecting fuel downstream from the seat portion, in which a concave surface denting in a direction opposite to a fuel injecting direction is formed on an outer peripheral side away from the injection hole at an end face on the downstream side of the seat member, and the concave surface is formed such that a material surface in an outer peripheral region has a larger wettability for the fuel than wettability in an inner peripheral region.

Advantageous Effects of Invention

According to the present invention, generation of deposit in the vicinity of an outlet of an injection hole is prevented, so that a fuel injection apparatus causing little change in a spray pattern or an injection flow rate over time can be achieved.

Other problems, structures, and effects that have not been described above will be apparent from the following description of the embodiment.

DESCRIPTION OF EMBODIMENTS

In the following, an embodiment of the present invention will be described by referring to the accompanying drawings.

First Embodiment

Figure 1:
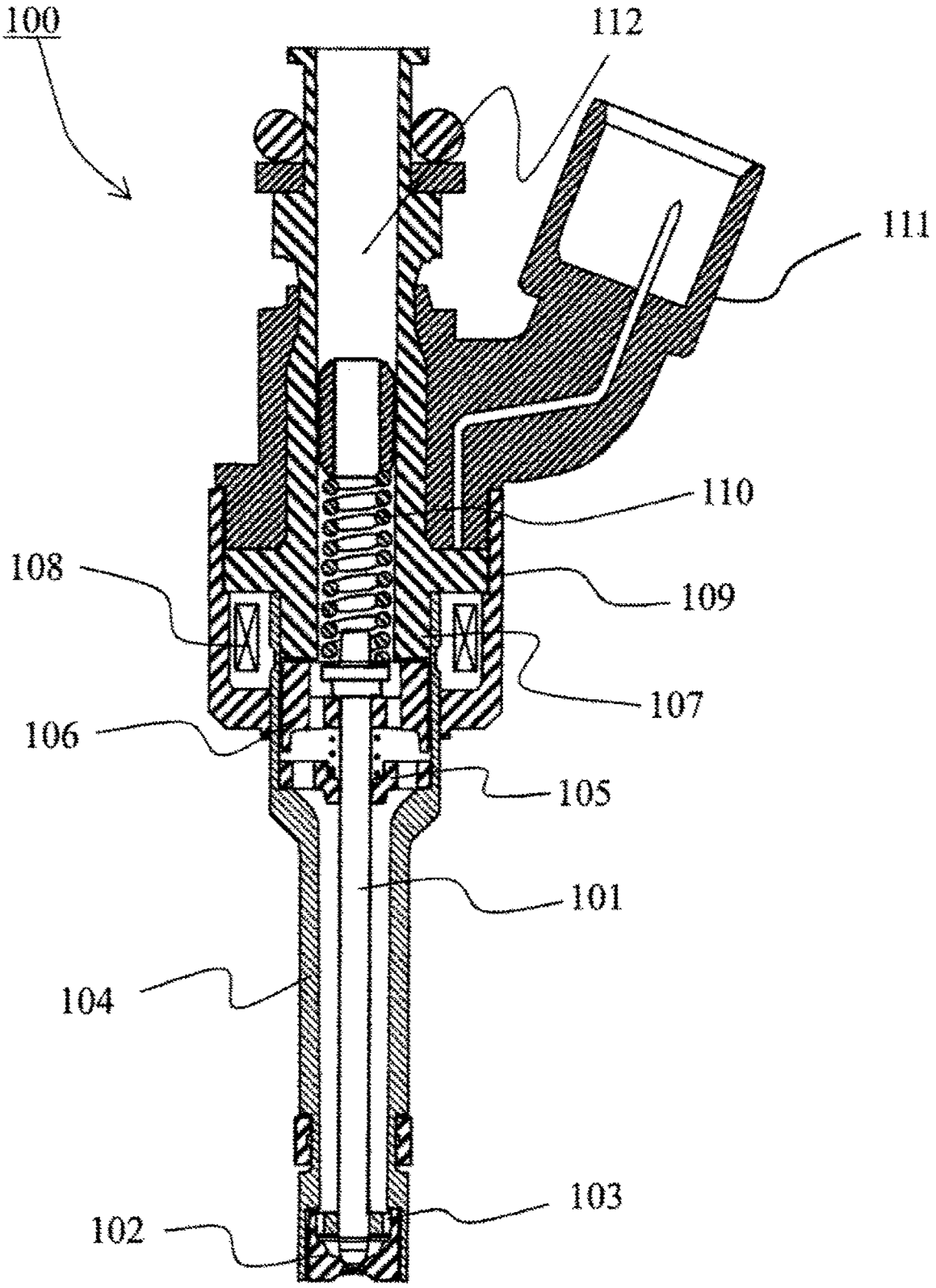
FIG. 1 is a cross-sectional view of an embodiment of a fuel injection valve according to the present invention.
Figure 2:
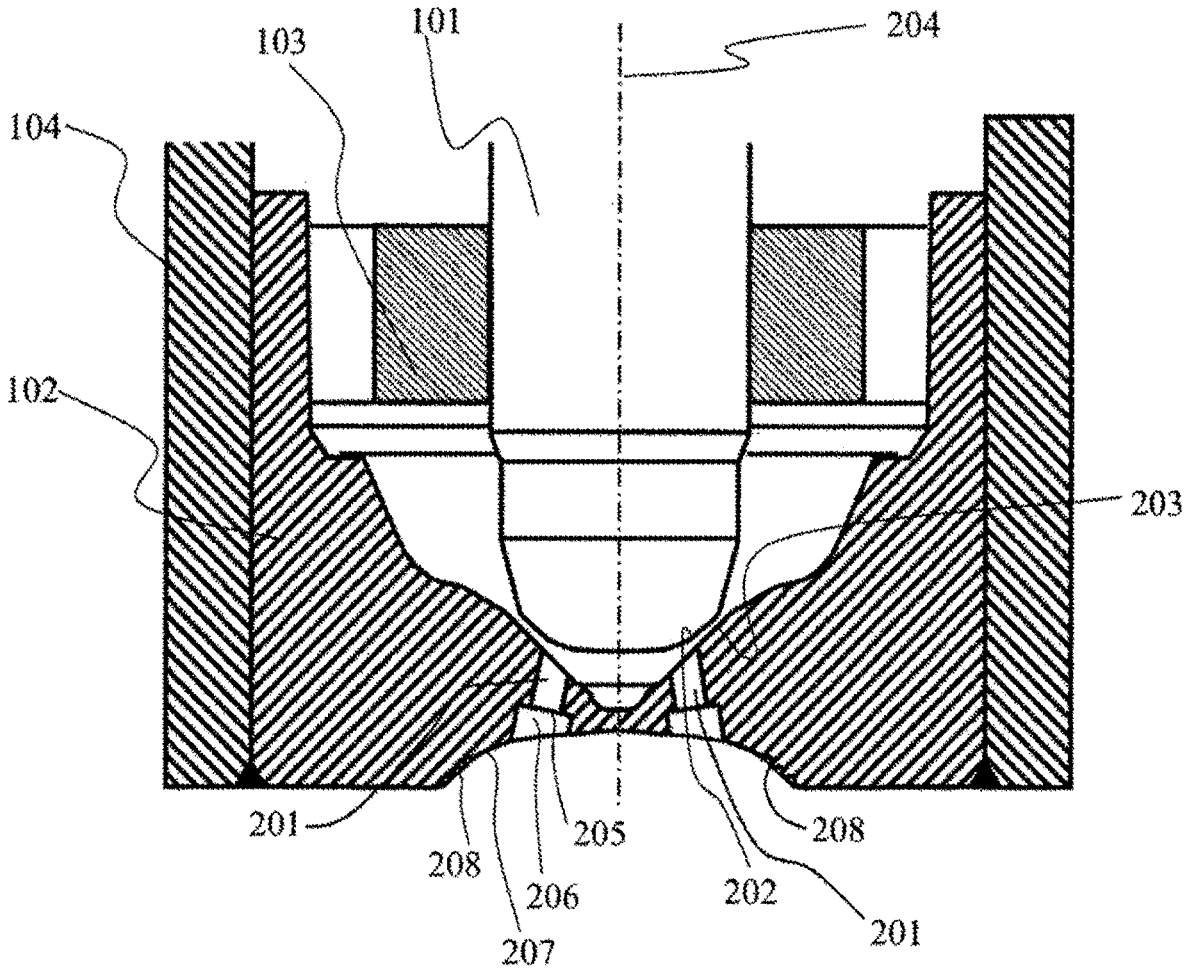
FIG. 2 is an enlarged cross-sectional view in the vicinity of a tip end of a valve body of a fuel injection valve according to a first embodiment of the present invention, in which a dimple is formed on a material surface in an outer peripheral region of a concave surface.
Figure 3:
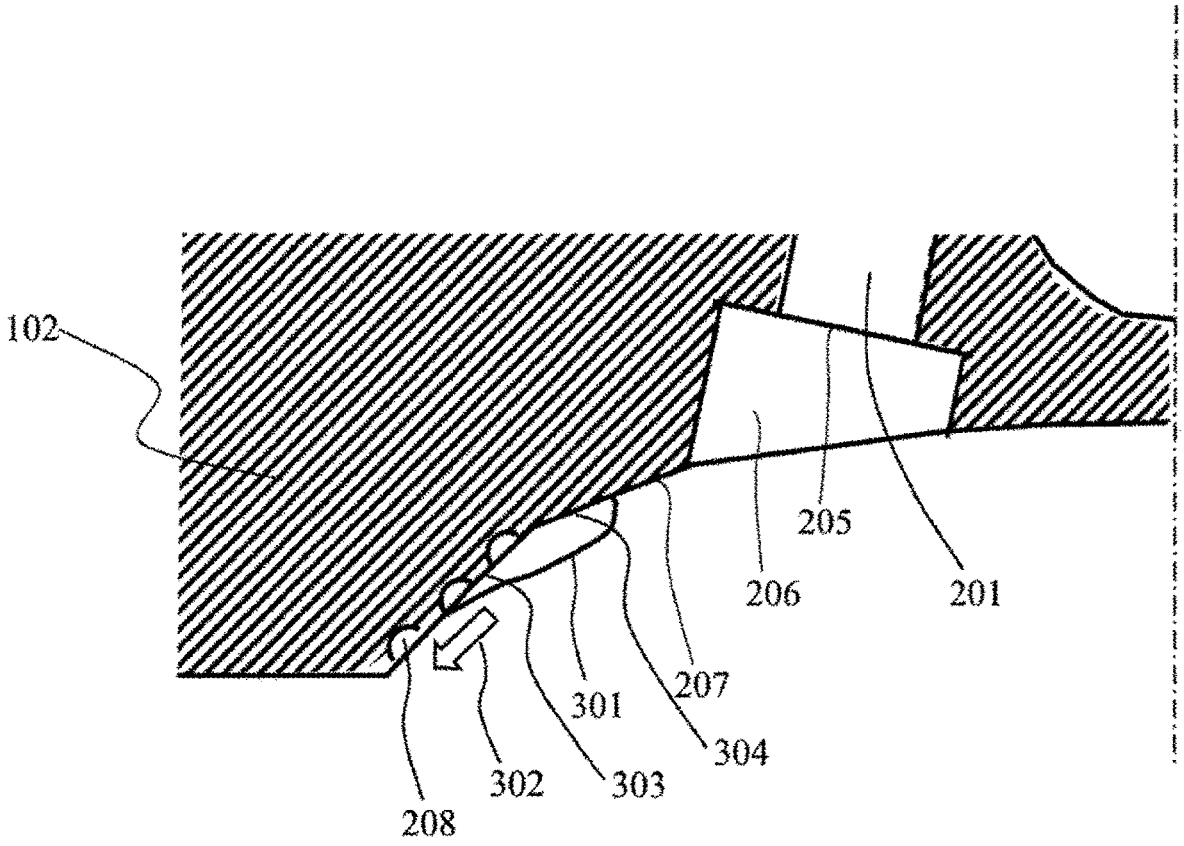
FIG. 3 is a view for explaining an advantageous effect of the first embodiment of the present invention.
Figure 9:
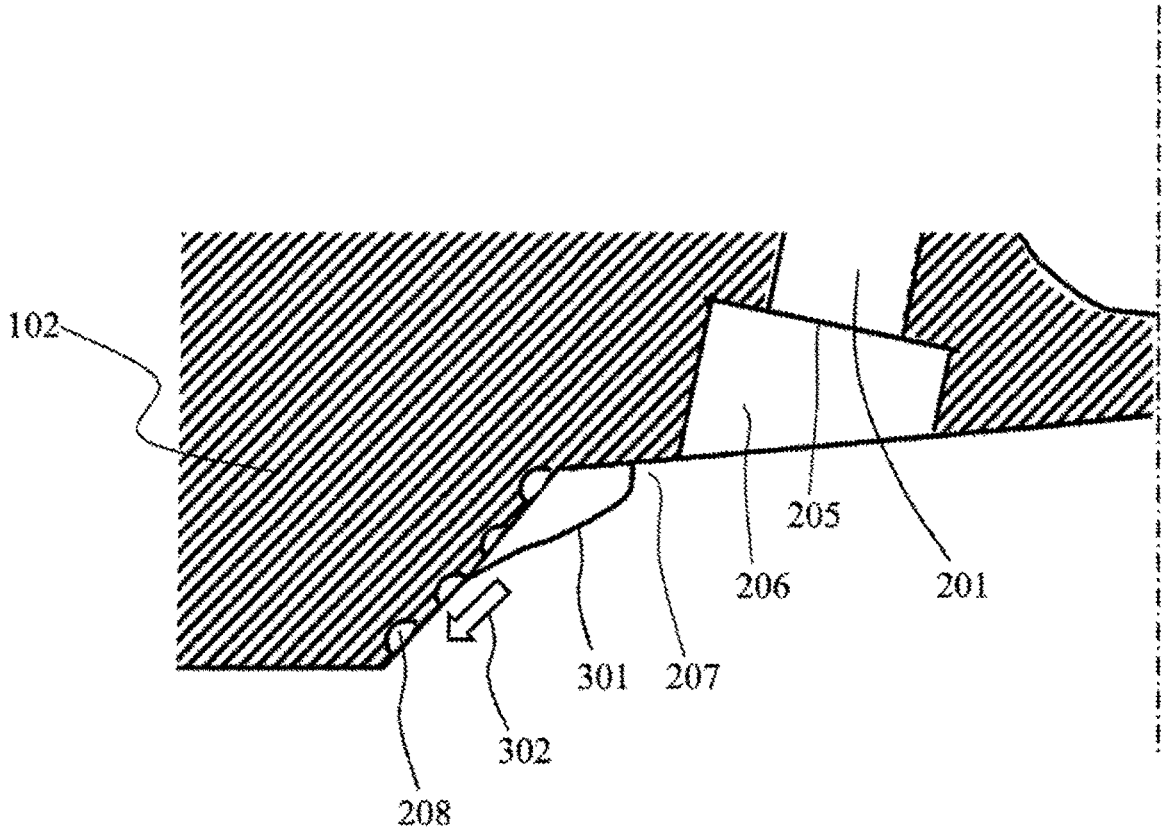
FIG. 9 is an enlarged cross-sectional view in the vicinity of a tip end of a valve body of a fuel injection valve according to a seventh embodiment of the present invention, and is also a further simplified view of FIG. 2 of the first embodiment.

A fuel injection valve according to a first embodiment of the present invention is described below by referring to FIGS. 1, 2, 3, and 9. FIG. 1 is a cross-sectional view of an embodiment of a fuel injection valve according to the present invention. FIG. 2 is an enlarged cross-sectional view in the vicinity of a tip end of a valve body of a fuel injection valve according to the first embodiment of the present invention, in which a dimple is formed on a material surface in an outer peripheral region of a concave surface. FIG. 3 is a view for explaining an advantageous effect of the first embodiment of the present invention. FIG. 9 is an enlarged cross-sectional view in the vicinity of a tip end of a valve body of a fuel injection valve according to a seventh embodiment of the present invention, and is a further simplified view of FIG. 2 of the first embodiment.

A basic operation of the fuel injection valve of the present embodiment is described below. In FIG. 1, fuel is supplied from a fuel supply inlet 112 to the interior of the fuel injection valve. An electromagnetic fuel injection valve 100 illustrated in FIG. 1 is a normally-closed type electromagnetic fuel injection valve. When no electricity is applied to a coil 108, a valve body 101 is energized by a spring 110 to be pressed against a seat member 102 to allow sealing of the fuel. At this time, a fuel pressure supplied to the fuel injection valve for cylinder injection is approximately in a range from 1 MPa to 35 MPa.

FIG. 2 is an enlarged cross-sectional view of the vicinity of an injection nozzle provided at a tip end of a valve body. When the fuel injection valve is in a closed state, the valve body 101 touches a valve seat surface 203 formed of a conical surface on the seat member 102 that is bonded to a nozzle body 104 by, for example, welding, thus maintaining sealing of the fuel. At this time, a contact portion on the valve body 101 side is formed by a spherical surface 202, so that the conical valve seat surface 203 touches the spherical surface 202 nearly linearly. When electricity is supplied to the coil 108 of FIG. 1, a core 107, a yoke 109, and an anchor 106, which are constituent components of an electromagnetic circuit of the electromagnetic valve, generate a magnetic flux density to eventually generate a magnetic attractive force in a gap between the core 107 and the anchor 106. If the magnetic attractive force comes to be larger than force generated by an energizing force of the spring 110 and the fuel pressure, the valve body 101 is attracted toward the core 107 by the anchor 106, as being guided by a guide member 103 and a valve body guide 105, and enters a valve open state.

In the valve open state, a gap is formed between the valve seat surface 203 and the spherical surface portion 202 of the valve body, and the fuel injection starts. When the fuel injection starts, the energy provided as a fuel pressure is converted into kinetic energy which then reaches a fuel injection nozzle 201 for injection.

FIG. 3 is a view for explaining an advantageous effect of the present embodiment. When the fuel is injected from the injection hole 201, airborne droplets of the fuel or fuel spray swaying laterally at nearly closing timing of the valve is adhered to a lower end face 207 of the fuel injection valve as a liquid film or a liquid droplet, as indicated by 301 of FIG. 3. The adhered fuel grows every time the injection is carried out and is eventually accumulated in the vicinity of the outlet of a counterbore portion 206 at the outlet of the injection hole. The accumulated fuel is a factor to generate the deposit.

As described above, the electromagnetic fuel injection valve 100 includes the seat member 102 having the valve seat on its inner wall surface, and the valve body 101 that moves away from or is seated on the seat member 102. In addition, a fuel channel is formed between the seat member and the valve body 101. Further, the seat member 102 also includes the injection hole 201 that injects fuel downstream from the seat portion on which the valve body 101 is seated. The electromagnetic fuel injection valve 100 also includes, on the lower end face 207 on the fuel outlet side of the fuel injection hole, i.e., on the end face 207 on the downstream side of the seat member 102, a concave surface 207 denting in a direction opposite to a fuel injecting direction is formed in an outer peripheral region beyond each of the injection hole about a center axis of the electromagnetic fuel injection valve 100.

As illustrated in FIG. 3, the concave surface 207 is formed such that, when seen from the center axis of the electromagnetic fuel injection valve 100, a material surface has a larger wettability for the fuel in an outer peripheral region 303 than wettability in an inner peripheral region 304. That is, the outer peripheral region 303 of the concave surface 207 can be wet easier than the inner peripheral region 304. On the contrary, the inner peripheral region 304 has a better oil-repellent characteristic than the outer peripheral region 303 on the concave surface 207.

At this time, if the fuel is adhered to the concave surface 207, a contact angle between the fuel and the material surface of the concave surface 207 becomes smaller in the outer peripheral region 303 than in the inner peripheral region 304. More specifically, a dimple 208 is formed in the outer peripheral region 303, as illustrated in FIG. 3. That is, a recess denting in the direction opposite to the fuel injecting direction is formed in the outer peripheral region 303. Three dimples 208 are formed in FIG. 3, but the number of dimples formed is not limited as long as it is more than or equal to one. That is, a surface roughness of the material surface of the outer peripheral region 303 of the concave surface 207 is made coarser than the surface roughness of the inner peripheral region 304. Thus, the material surface has the wettability for the fuel on the material surface in the outer peripheral region 303 of the concave surface 207 to allow wetting more easily than in the inner peripheral region 304 of the concave surface 207.

Thus, by changing the wettability of the material surface, the liquid films or liquid droplets of the fuel accumulated on the lower end face 207 of the fuel injection valve move toward the outer peripheral side having a better wettability in the direction of an arrow 302 to reduce accumulation of the fuel in the vicinity of the fuel injection hole 201.

In the present embodiment, the concave surface 207 is formed by connecting the outer peripheral region 303 and the inner peripheral region 304, both formed nearly linearly, at a certain angle. When seen in the cross-sectional view, by connecting the regions nearly linearly, the processing can be carried out easily.

Second Embodiment

Figure 4:
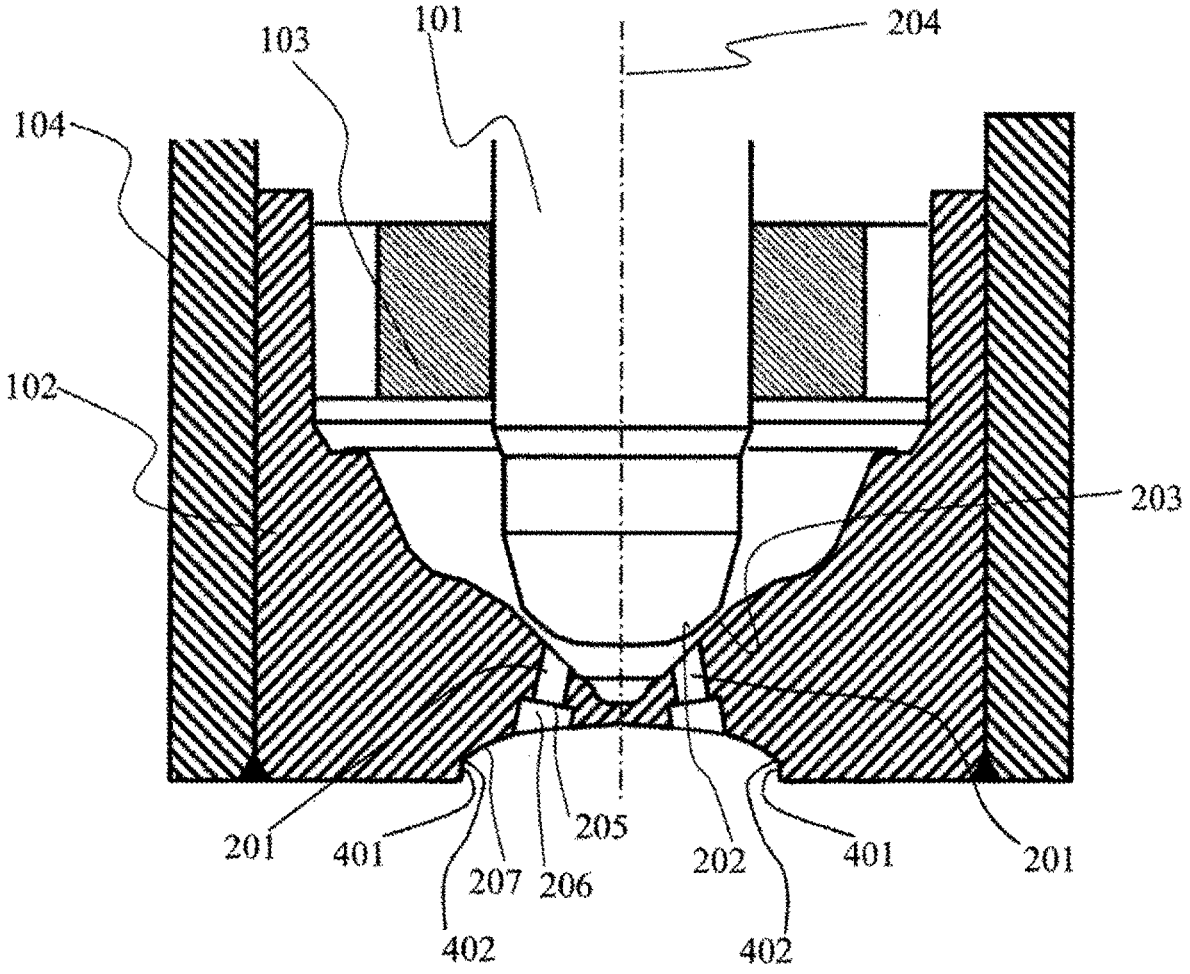
FIG. 4 is an enlarged cross-sectional view in the vicinity of a tip end of a valve body of a fuel injection valve according to a second embodiment of the present invention, in which an edge portion is formed on a material surface in an outer peripheral region of a concave surface.

A fuel injection valve according to a second embodiment of the present invention is described below by referring to FIG. 4. FIG. 4 is an enlarged cross-sectional view in the vicinity of a tip end of a valve body of a fuel injection valve according to the present embodiment, in which an edge portion is formed on a material surface in an outer peripheral region of the concave surface. In the second embodiment, the concave surface is formed of a surface 207 and a surface 401 relative to a fuel injecting direction, and an edge portion 402 is formed on a lower end face of the fuel injection valve in the outer peripheral region where no injection hole is present relative to a center axis of the fuel injection valve.

In the present embodiment, the surface 401 is formed in approximately the same direction as an axial direction of an electromagnetic fuel injection valve 100, and the edge portion 402 is formed at an intersection of the surfaces 401 and 207. At this time, a crossing angle between the surfaces 401 and 207 is preferably from 90 degrees to 180 degrees. Further, the edge portion 402 is preferably formed on the outer peripheral side relative to the center of the concave surface.

When touching the edge portion 402, liquid films or liquid droplets of fuel accumulated on the lower end face of the fuel injection valve are trapped in the edge portion 402 due to a surface tension effect. As a result, the liquid films and the liquid droplets are attracted toward an edge side, so that the accumulation of the fuel in the vicinity of a fuel injection hole 201 can be reduced.

Third Embodiment

Figure 5:
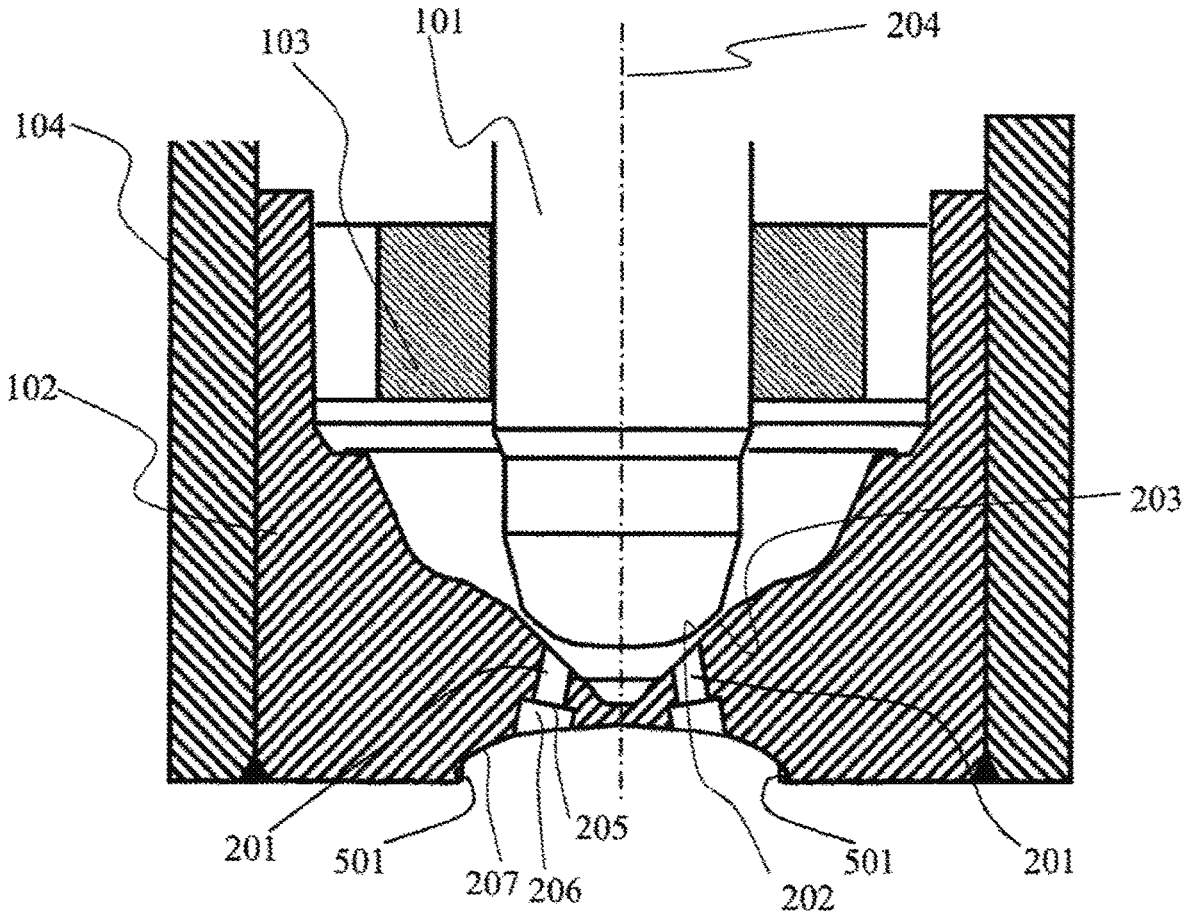
FIG. 5 is an enlarged cross-sectional view in the vicinity of a tip end of a valve body of a fuel injection valve according to a third embodiment of the present invention, in which a dimple is formed at a portion between the edge portion and the outer periphery of the second embodiment (FIG. 4).

A fuel injection valve according to a third embodiment of the present invention is described below by referring to FIG. 5. FIG. 5 is an enlarged cross-sectional view in the vicinity of a tip end of a valve body of a fuel injection valve according to the present embodiment, in which a dimple 501 is formed at a portion between the edge portion 402 and the outer peripheral surface 401 of the second embodiment of FIG. 4. Thus, liquid droplets or liquid films trapped in the edge portion 402 of FIG. 4 move onto the surface 401, so that the liquid droplets or liquid films can further be away from an injection hole.

As illustrated in FIGS. 2, 4, and 5, an end face on a downstream side of a seat member 102 is formed such that entire inner and outer peripheral sides of the injection hole 201 are formed in a concave shape denting in a direction opposite to the fuel injecting direction.

Fourth Embodiment

Figure 6:
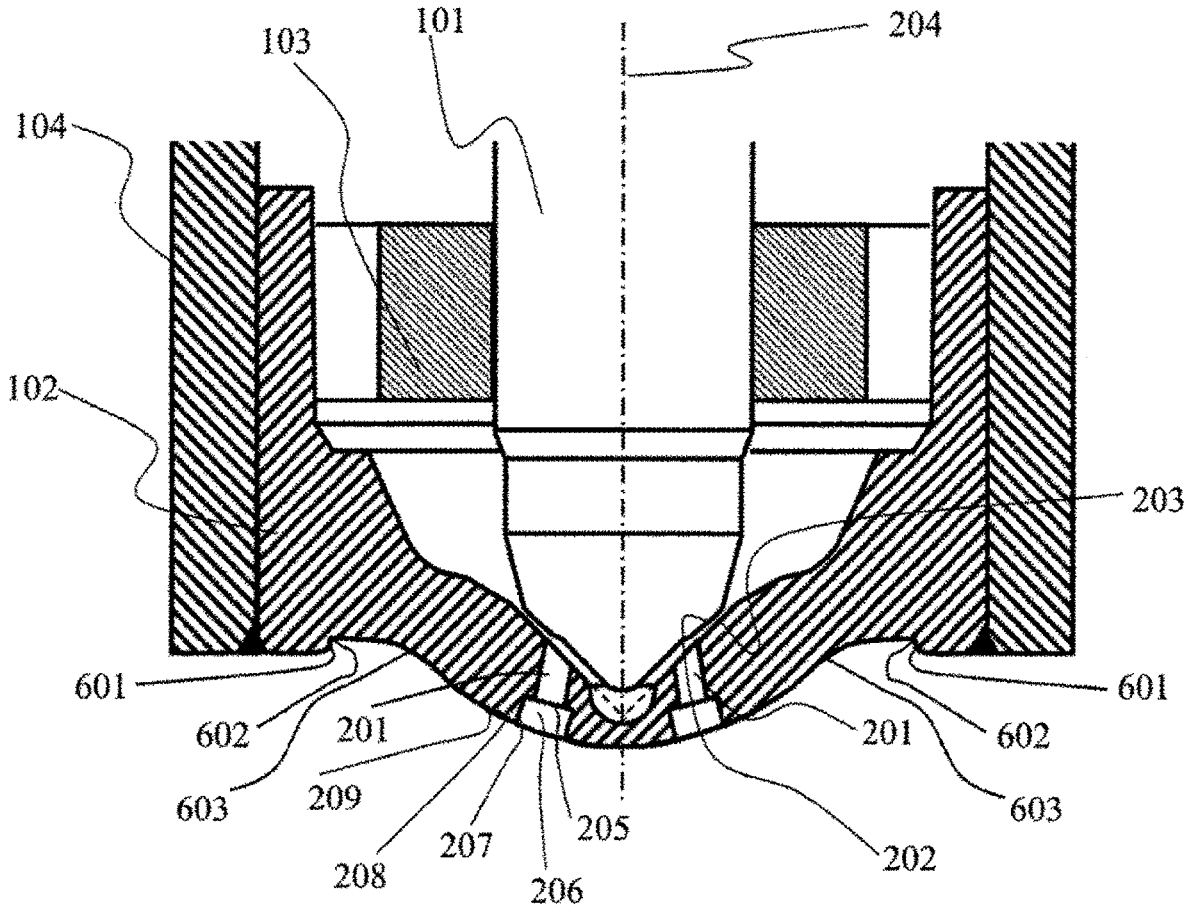
FIG. 6 is an enlarged cross-sectional view in the vicinity of a tip end of a valve body of a fuel injection valve according to a fourth embodiment of the present invention, in which a concave shape is formed relative to a fuel injecting direction on an outer peripheral side of a convex shape, and an edge portion is formed on an outer peripheral portion of the concave shape.

A fuel injection valve according to a fourth embodiment of the present invention is described below by referring to FIG. 6. FIG. 6 is an enlarged cross-sectional view in the vicinity of a tip end of a valve body of a fuel injection valve according to the present embodiment, in which a concave surface 603 is formed relative to a fuel injecting direction on an outer peripheral side of a convex surface 209, and an edge portion 603 is formed on an outer peripheral portion 601 of the concave surface 603. Specifically, the convex surface 209 projecting in the fuel injecting direction is formed on the outer peripheral side of an injection hole 201, while the concave surface 603 denting in a direction opposite to the fuel injecting direction is formed on the further outer peripheral side of the convex surface 209 on a downstream end face of a seat member 102.

Fuel accumulated on a lower end face of the fuel injection valve is easily accumulated in the concave surface 603. Since an edge 602 is provided in an outer peripheral region of the concave surface 603, liquid droplets or liquid films accumulated on the lower end face of the fuel injection valve are attracted to an edge portion 602 due to the reason mentioned above.

In the present embodiment, the outer peripheral portion 601 is formed approximately in the same direction as an axial direction of an electromagnetic fuel injection valve 100, and the edge portion 602 is formed at an intersection between the outer peripheral portion 601 and the concave surface 603. At this time, a crossing angle between the outer peripheral portion 601 and the concave surface 603 is desirably from 90 degrees to 180 degrees. The edge portion 602 is desirably formed on the outer peripheral side relative to the center of the concave surface 603.

As a result, a surface area of accumulated liquid droplets or liquid films increases and a film thickness of the accumulated fuel decreases, thus accelerating evaporation of the fuel and reducing deposit.

Fifth Embodiment

Figure 7:
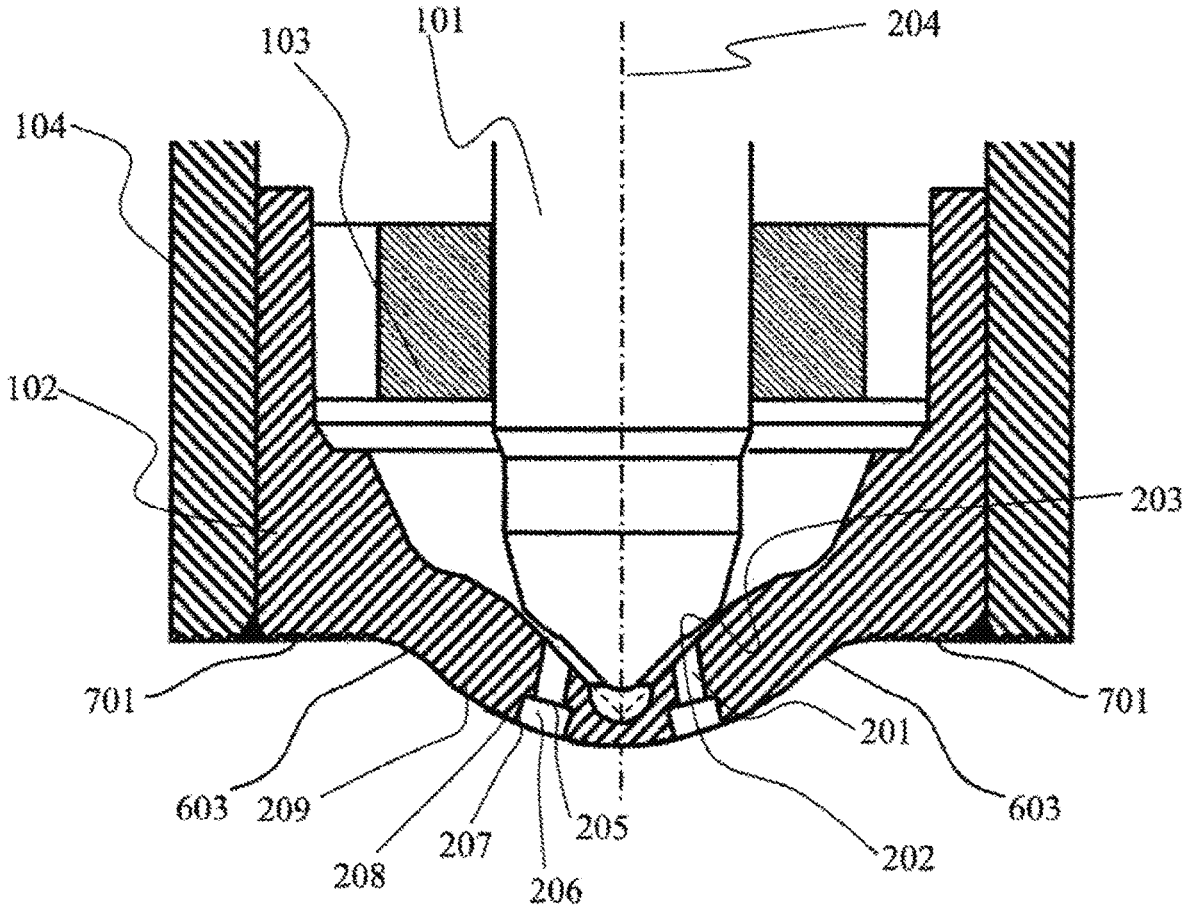
FIG. 7 is an enlarged cross-sectional view of the vicinity of a tip end of a valve body of a fuel injection valve according to a fifth embodiment of the present invention, in which a concave shape is formed relative to a fuel injecting direction on an outer peripheral side of a convex shape, and a dimple is formed on an outer peripheral portion of the concave shape.

A fuel injection valve according to a fifth embodiment of the present invention is described below by referring to FIG. 7. FIG. 7 is an enlarged cross-sectional view in the vicinity of a tip end of a valve body of a fuel injection valve according to the present embodiment, in which a concave surface 603 denting in a direction opposite to a fuel injecting direction is formed on an outer peripheral side of a convex shape 209. Then, a dimple 701 is formed on an outer peripheral side of the concave surface 603 in an end face located downstream of a seat member 102. In the present embodiment, fuel accumulated on a concave shape 603 can be moved further to the outer peripheral side using the dimple 701. As a result, deposit can be reduced.

Sixth Embodiment

Figure 8:
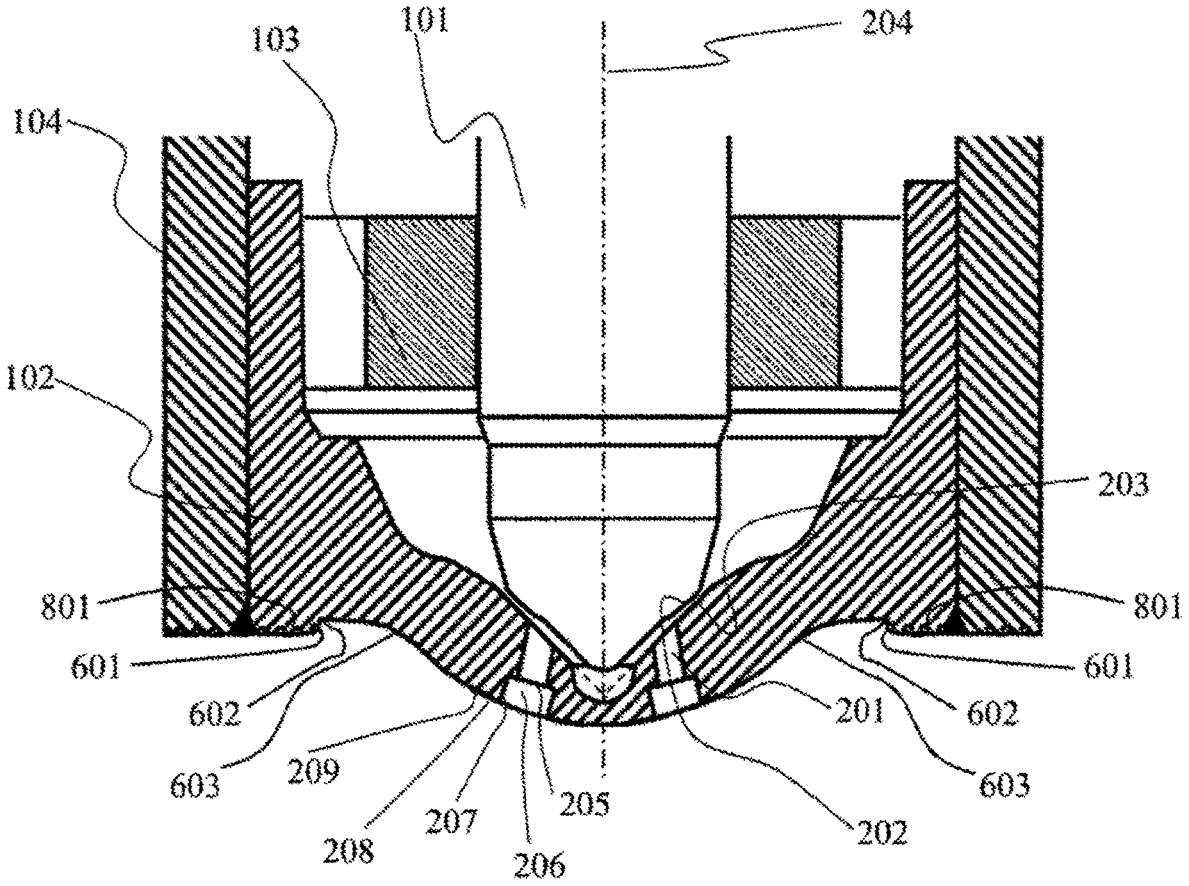
FIG. 8 is an enlarged cross-sectional view in the vicinity of a tip end of a valve body of a fuel injection valve according to a sixth embodiment of the present invention, in which a concave shape is formed relative to a fuel injecting direction on an outer peripheral side of a convex shape, an edge portion is formed on an outer peripheral portion of the concave shape, and a dimple is formed on the outer peripheral side of the edge portion.

A fuel injection valve according to a sixth embodiment of the present invention is described below by referring to FIG. 8. FIG. 8 is an enlarged cross-sectional view in the vicinity of a tip end of a valve body of a fuel injection valve according to the present embodiment, in which a concave shape 603 is formed relative to a fuel injecting direction on an outer peripheral side of a convex shape 209, an edge portion 602 is formed on an outer peripheral portion of the concave shape 603, and further a dimple is formed on an outer peripheral side 601 of the edge portion. Thus, liquid droplets or liquid films trapped in the edge portion go beyond the edge portion to spread to the outer peripheral side. Further, since an inner peripheral interface of the liquid droplets or liquid films are trapped in the edge portion, the liquid droplets or liquid films are formed concentrated on the outer peripheral side of the edge portion.

Seventh Embodiment

A fuel injection valve according to a seventh embodiment of the present invention is described below by referring to FIG. 9. FIG. 9 is an enlarged cross-sectional view in the vicinity of a tip end of a valve body of a fuel injection valve according to a seventh embodiment of the present invention, and is a further simplified view of FIG. 2 of the first embodiment. Even if a lower end face of the fuel injection valve can be thus formed planarly, a similar effect can be obtained.

As described above, the wettability for the fuel of the concave shape is changed using the dimples. Alternatively, the similar effect can be obtained by increasing the surface roughness to improve the wettability, for example. Instead of the dimples, a similar effect can be obtained with a thin groove formed concentrically about the center axis of the fuel injection valve.

As described in the embodiments above, by implementing the fuel injection apparatus (electromagnetic fuel injection valve 100) which prevents the generation of the deposit in the vicinity of the outlet of the injection hole 201 and in which the spray pattern or the injection flow rate does not largely change over time, the internal combustion engine with improved exhaust performance and fuel consumption efficiency can be implemented.

REFERENCE SIGNS LIST

100 electromagnetic fuel injection valve
101 valve body
102 valve seat member (seat member)
103 guide member
104 nozzle body
105 valve body guide
106 movable element
107 magnetic core
108 coil
109 yoke
110 energizing spring
111 connector
112 fuel supply inlet
201 injection nozzle (fuel injection hole)
202 spherical surface of valve body
203 valve seat surface
204 vertical center axis of fuel injection valve
205 step portion
206 counterbore portion
207 lower end concave surface of fuel injection valve
208 dimple on outer peripheral side of concave curved surface
209 convex curved surface
301 liquid droplet or liquid film
302 moving direction of liquid droplet or liquid film
303 outer peripheral region of concave surface
304 inner peripheral region of concave surface
401 outer peripheral region of edge portion
402 edge portion
501 dimple formed on outer peripheral side of edge portion
601 outer peripheral region of edge portion
602 edge portion
603 concave shape formed on outer peripheral side of convex shape 209
701 dimple formed on outer peripheral side of concave curved surface
701 dimple formed on outer peripheral side of edge 602

The invention claimed is:

1. A fuel injection valve, comprising:
a valve body;
a first seat portion on which the valve body is seated; and
a second seat portion in which an injection hole for injecting fuel is formed downstream from the first seat portion,
wherein a concave surface denting in a direction opposite to a fuel injecting direction is formed on an outer peripheral side away from the injection hole at an end face located downstream from the first seat portion, and
the concave surface has wettability for fuel on a material surface in an outer peripheral region larger than wettability in an inner peripheral region.

2. The fuel injection valve according to claim 1, wherein
a dimple is formed on the material surface in the outer peripheral region of the concave surface.

3. The fuel injection valve according to claim 1, wherein
an edge portion is formed on the material surface in the outer peripheral region of the concave surface.

4. The fuel injection valve according to claim 3, wherein
a dimple is formed on the material surface in the outer peripheral region away from the edge portion and in the outer peripheral region of the concave surface.

5. The fuel injection valve according to claim 1, wherein
the material surface in the outer peripheral region of the concave surface is configured to have a surface roughness coarser than a surface roughness in the inner peripheral region.

6. The fuel injection valve according to claim 1, wherein
a convex surface projecting in the fuel injecting direction is formed on the outer peripheral side away from the injection hole and on the inner peripheral side of the concave surface at the end face on the downstream side of the first seat portion.

7. The fuel injection valve according to claim 6, wherein
an edge portion is formed on the material surface in the outer peripheral region of the concave surface.

8. The fuel injection valve according to claim 1, wherein
the end face on the downstream side of the first seat portion is formed in a concave shape denting in the direction opposite to the fuel injecting direction on the inner peripheral side and the outer peripheral side of the injection hole.

9. A fuel injection valve, comprising:
a valve body;
a first seat portion on which the valve body is seated; and
a second seat portion in which an injection hole for injecting fuel is formed downstream from the seat portion, wherein
a concave surface denting in a direction opposite to a fuel injecting direction is formed on an outer peripheral side away from the injection hole in an end face located downstream of the first seat portion, and
a dimple is formed on a material surface on the outer peripheral side away from the concave surface at an end surface on the downstream side of the first seat portion.

10. The fuel injection valve according to claim 9, wherein
the end face on the downstream side of the first seat portion is formed in a concave shape denting in the direction opposite to the fuel injecting direction on the inner peripheral side and the outer peripheral side of the injection hole.

* * * * *